US006870796B2

(12) United States Patent
Elling

(10) Patent No.: US 6,870,796 B2
(45) Date of Patent: Mar. 22, 2005

(54) CAP AND TIMEPIECE DEVICE

(75) Inventor: Gary D. Elling, 30 West St., Bloomsbury, NJ (US) 08804

(73) Assignee: Gary D. Elling, Bloomsbury, NJ (US)

( * ) Notice: Subject to any disclaimer, the term of this patent is extended or adjusted under 35 U.S.C. 154(b) by 249 days.

(21) Appl. No.: 10/120,240

(22) Filed: Apr. 10, 2002

(65) Prior Publication Data

US 2003/0193844 A1 Oct. 16, 2003

(51) Int. Cl.[7] ..... G04B 47/00

(52) U.S. Cl. ..... 368/10; 368/282; 2/171; 2/209.13

(58) Field of Search ..... 2/171, 209.12, 2/209.13; 368/10, 223, 228, 281, 297–300, 309

(56) References Cited

U.S. PATENT DOCUMENTS

| | | | | | |
|---|---|---|---|---|---|
| 1,484,121 | A | * | 2/1924 | Ezekiel et al. | 224/181 |
| 1,677,144 | A | * | 7/1928 | Laska | 368/281 |
| 3,271,945 | A | * | 9/1966 | Anderson | 368/22 |
| 4,717,260 | A | * | 1/1988 | Tsuji | 368/21 |
| 4,918,759 | A | * | 4/1990 | Anderson et al. | 2/209.7 |
| 4,920,526 | A | | 4/1990 | Saito | 368/281 |
| 5,099,462 | A | | 3/1992 | Karowski | 368/10 |
| 5,511,045 | A | | 4/1996 | Sasaki et al. | 368/2 |
| 5,612,932 | A | | 3/1997 | Albenda | 368/276 |
| 5,775,011 | A | | 7/1998 | Reitano, Jr. | 36/136 |
| 6,234,668 | B1 | | 5/2001 | Cooper | 368/281 |

* cited by examiner

*Primary Examiner*—Vit W. Miska
(74) *Attorney, Agent, or Firm*—Kenneth P. Glynn

(57) ABSTRACT

The present invention is a timepiece, which has a unique orientation of its face for unusual positioning and reading. It includes a main housing, two strap attachment mechanisms and a faceplate with an abnormal orientation relative to the two strap attachment mechanisms, specifically, twelve o'clock on a faceplate is rotated about 90 degrees away from the strap attachment mechanisms, so that twelve o'clock in the present invention is situated in the conventional three o'clock position. The present invention is also directed to a cap-type hat with a timepiece connected thereto. The cap includes a skull-covering portion adapted to fit atop a human head, the skull-covering portion having a base perimeter and having a rear cutout at back portion thereof. There is also a cap strap extending across the rear cutout. There is a timepiece connected to the cap strap, wherein the cap strap simultaneously and synergistically is functional as a holding strap for the cap to enhance fittage to a human head, and is functional as a timepiece strap.

20 Claims, 4 Drawing Sheets

CAP AND TIMEPIECE DEVICE

BACKGROUND OF THE INVENTION

1. Field of the Invention

The present invention relates to unique hats with timepieces for synergistic purposes.

2. Information Disclosure Statement

The following patents describe hats or other articles which include timepieces:

U.S. Pat. No. 6,234,668 describes a holder for securing timepiece to an article, such as a backpack, tent, bicycle, or ski coat for example. In a preferred embodiment, the holder comprises a base which is securable to a watch case, and a cover to shield the watch case when it is attached to the base. In one embodiment, the watch case is secured to the base by an elastic strap which is of a width and thickness to fit between the pins of the watch case and the body of the watch case. The cover can comprise a flexible band which is moveable from an open position to a closed position, and which can be locked in the closed position. Rings may be provided at opposing ends of the base to connect the base to an article. A belt may be fed through the rings to assist in connecting the holder to the article.

U.S. Pat. No. 5,775,011 describes a display unit such as a digital or analog watch that is held in a wedge-shaped member to the top of footwear by a second tongue held, for example, with hook and loop fasteners, to the top of a sneaker or shoe. In another embodiment, the display unit can be held to the top of footwear by the laces of the footwear, which are threaded through a series of pairs of openings in the bottom of the display holder.

U.S. Pat. No. 5,612,932 describes a simple, inexpensive reliable an unobtrusive method of attaching a watch or other timepiece to anything with an edge without damaging the item the watch is attached to. The device is merely twisted onto the edged item (i.e. cap, sleeve, pocket, book, etc.) and placed at the proper angle. The attaching device is a spiral type of apparatus that is attached or molded into the back of the watch. The device is springy enough to open, yet rigid enough to hold the timepiece in place when twisted onto the intended item.

U.S. Pat. No. 5,511,045 describes an apparatus designed to automatically measure the total moving time, split times, time lag, and the like of each of a plurality of moving objects, and determine the arriving order of each moving object. Every time a plurality of moving objects, e.g., runners or vehicles, pass through each predetermined point, pieces of information such as total running/moving times, split times, time lags, and arriving orders are transmitted, in units of moving objects, to the respective moving objects or a transmission/reception unit arranged at each predetermined point. When moving objects pass through a predetermined point, and their moving times exceed passage times set in units of moving objects, an excess time is informed to each moving object.

U.S. Pat. No. 5,099,462 describes an invention that provides a rigid construction hat defining shell mounting a timepiece for ease of visibility by an individual to minimize accidental injury in the typical wearing of a wristwatch. The timepiece is removeably mounted relative to a bottom surface of the brim via magnetic means and includes illumination means to provide light to four quadrants of the timepiece through the fiber optic cables.

U.S. Pat. No. 4,920,526 describes a timepiece composed of a sheet on the surface of which any suitable patterns or characters can be printed, and a timepiece driving section fixed to the back of the sheet, said sheet having a cut out section the contour of which substantially corresponds to that of a time display section of said timepiece driving section. Various designs can simply be applied to the sheet of said timepiece through a printing process. On the other hand, when said sheet is shaped or cut off into a certain configuration, the resulting timepiece can be used in various applications such as wrist watch, table-clock, wall-clock and the like.

Notwithstanding the prior art, the present invention is neither taught nor rendered obvious thereby.

SUMMARY OF THE INVENTION

The present invention is a timepiece, which has a unique orientation of its face for unusual positioning and reading. It includes a main housing, two strap attachment mechanisms and a faceplate with an abnormal orientation relative to the two strap attachment mechanisms. The main housing has a front and a back, and contains a functional timekeeping means for timely driving at least an hour hand and a minute hand. The front of the main housing is adapted for presenting a timepiece face (e.g., glass or plastic) and faceplate. The back is substantially flat.

The front of the main housing has an imaginary centerline extending outwardly from the main housing. There are two strap attachment mechanisms connected to the main housing, one of the two strap attachment mechanisms being centered about the imaginary centerline at a first end of the imaginary centerline, and the other of the two strap attachment mechanisms being centered about the imaginary centerline opposite the other one, at a second end of the imaginary centerline.

A faceplate is located in said the housing face, and has at least a twelve symbol located thereon, wherein the twelve symbol is located about 90 degrees from the centerline. There is also a time hands driving shaft connected to and extending from the timekeeping means through the faceplate. An hour hand and a minute hand are functionally connected to the driving shaft.

In some preferred embodiments, the strap attachment mechanisms are symmetrical and directly opposite one another along the imaginary centerline. The strap attachment mechanisms may be any known or available strap attachment mechanisms. For example, the strap attachment mechanisms may be pairs of protrusions with strap pins. Alternatively, the strap attachment mechanisms may be selected from the group consisting of slotted receivers, flexible loops, inflexible loops and clamping strap attachments. The timepiece may be attached to any type of strap, e. g., a leather, cloth, plastic or metal strap, expandable, elastic, hooked, buckled or otherwise.

The present invention is also directed to a cap-type hat with a timepiece connected thereto. The cap includes a skull-covering portion adapted to fit atop a human head, the skull-covering portion having a base perimeter and having a rear cutout at back portion thereof. There is also a cap strap extending across the rear cutout. In its extreme, the rear cutout extends forward to the front, and the only skull-covering portion is the visor, and the circumferential band of the visor is the strap. Hence, by definition, "caps" of the present invention shall include visors.

There is a timepiece connected to the cap strap, wherein the cap strap simultaneously and synergistically is functional as a holding strap for the cap to enhance fittage to a human head, and is functional as a timepiece strap.

In most preferred embodiments, the cap strap is an adjustable strap. For example, the cap strap may be an elastically expandable strap. Alternatively, the cap strap is a two piece strap and has adjustment means for varied length connection of each of the two pieces of the strap. For example, it may be an insertable flex-buckle adjustment means. In the alternative, the adjustment means may be a plurality of orifices located on a first strap piece and at least one orifice-insertable protrusion on a second strap piece. The adjustment means could alternatively be a buckle on a first strap piece and a plurality of buckle holes on a second strap piece; or, it could be a clamp receiver buckle located on one of said two strap pieces, or any other known or available means.

In some preferred embodiments, the present invention cap with timepiece has a timepiece that includes two straps attachment mechanisms connected to a main housing, the two strap attachment mechanisms are at opposite ends of the main housing.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
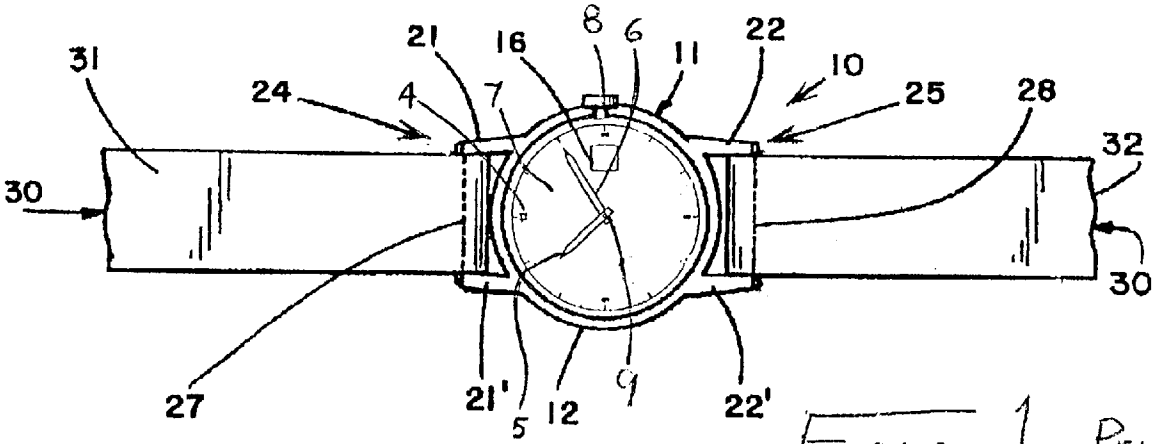
Figure 1 Prior Art
FIG. 1 shows a front view of a conventional prior art wristwatch type timepiece.

FIG. 1 shows a front view of a conventional prior art wristwatch 10. Wristwatch 10 includes a wrist strap 30, and a timepiece 11. Timepiece 11 includes a main housing 12, with a faceplate 7, and an hour hand 5, a minute hand 6. The main housing contains functional timekeeping means inside (not shown, but well within the purview of the artisan), which is connected to a driving shaft 9, which operates the hands 5 and 6, to present time. There is also a date presentation 16 and a reset and/or wind-up stem 8, as shown. Main housing 12 has two strap attachment mechanisms 24 and 25 opposite one another, and, in this case, symmetrical. Mechanisms 24 and 25, respectively, each have two protrusions 21, 21' and 22, 22'. These protrusions are adapted to receive strap pins 27 and 28, to removably attach the timepiece 11 to the strap 30. The strap 30 has two pieces 31 and 32, and they may be connected to one another by any available connecting means, or they may together form a single strap, e.g., an elastic or expandable strap.

Note that 12 o'clock is positioned on faceplate 7 in alignment with the strap pieces 31 and 32 and strap attachment mechanisms 24 and 25. This is normal for a watch, because the arm on which it is worn is brought in front of the wearer to tell time, wherein the thumb typically faces the stomach. This presents the 12 o'clock position furthest away from the wearer with the hours in an upright, readable fashion. The present invention timepieces, on the otherhand, discard this conventional wisdom to present a timepiece with a different orientation and with its own benefits for a user.

Figure 3:
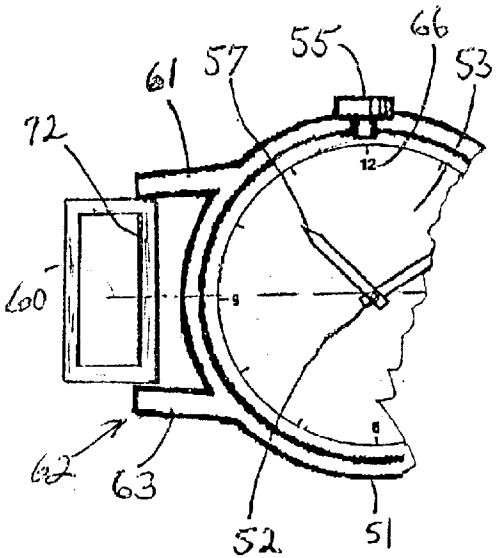
FIGS. 2, 3, and 4 each show front or partial front views of various embodiments of present invention timepieces having unique twelve o'clock orientation relative to the strap attachment means.
Figure 2:
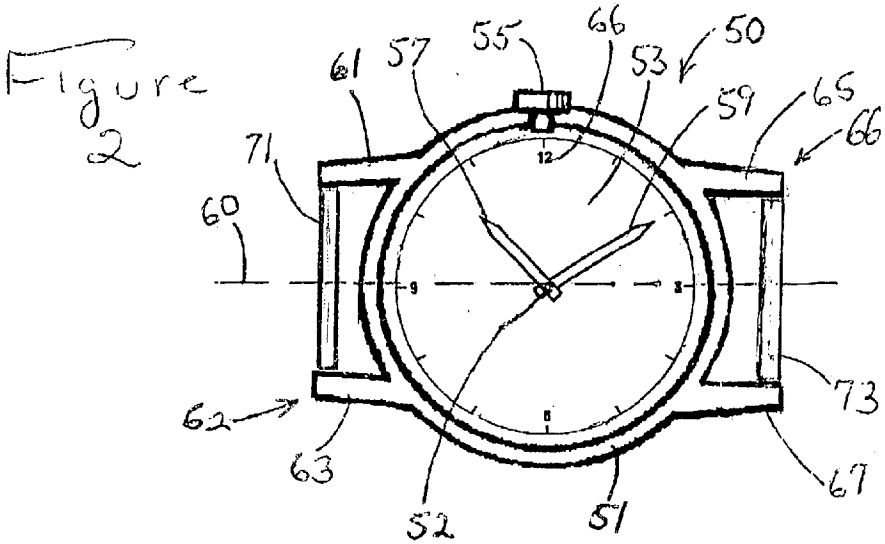
Figure 4:
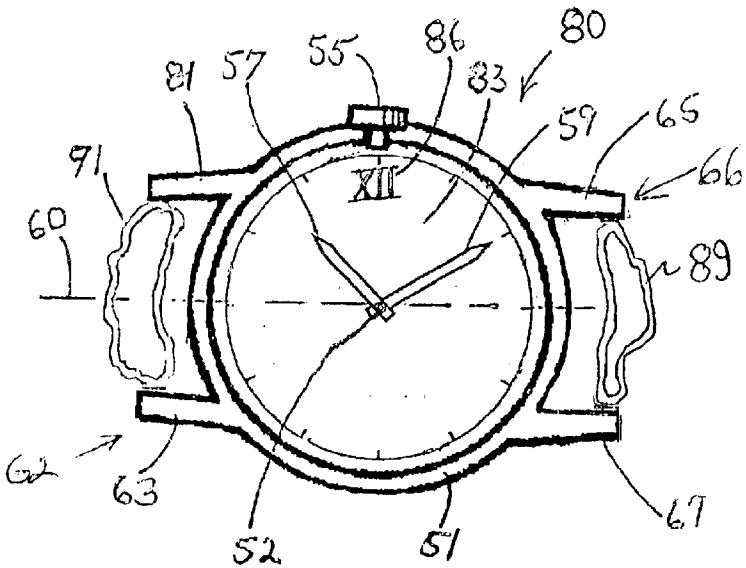

FIGS. 2, 3, and 4 each show front or partial front views of various embodiments of present invention timepieces having unique twelve o'clock orientations relative to the strap attachment means. In all three of these Figures, identical parts are identically numbered. Hence, in FIGS. 2, 3, and 4, the timepieces 50, 70, and 80, respectively, each have a main housing 51, with any conventional internal timekeeping mechanism which drives driving shaft 52, which, in turn, rotates the hour hand 57 and the minute hand 59 to present the time (a second hand could also be included). There is a faceplate 53 in the main housing 51, and stem 55 for resetting the time. There are two strap attachment mechanisms 62 and 66, each having a pair of protrusions 61, 63 and 65, 67, respectively, which contain an additional part for attachment to a strap. In FIG. 2, there are pins 71 and 73; in FIG. 3, there is a rectangular ring 72 (and its opposite counterpart, not shown); in FIG. 4, there are flexible, expandable bands 89 and 91. In each case there is some provision for attachment of the timepiece to a strap, and changes, variations and equivalents are contemplated as within the scope of the invention herein.

There is shown an imaginary centerline 60, which run through the centers of strap attachment mechanisms 62 and 66. Uniquely, twelve o'clock is not in alignments therewith, and instead is about 90 degrees rotated therefrom. Thus, in FIGS. 2 and 3, the number "12", designed as time 66, and in FIG. 4, the number "XII", designated as time 86, are all rotated about ninety degree for unique orientation, as shown. This orientation enables a user to attach the timepiece on a horizontal strap attachment-oriented base with horizontal readability achieved. For example, it could be strapped to a post, and the time units would be upright for easy reading. Likewise, the timepiece could be strapped any vertical member with small enough perimeter to achieve the horizontal strapping/horizontal reading arrangement. In one preferred application, it is attached to the strap of a cap for wearing on the head, wherein people accompanying the wearer can read the time from the back, and the user can read the time when the hat is removed, e.g., just to check the time, or when the cap is set on a shelf or other resting place. By having the present invention timepiece attached to the back of a cap strap, a significant synergistic result is achieved. First, the user, e.g., a construction worker does not need to worry about vibrational or impact damage to the timepiece, as would be the case when wearing a wristwatch and hammering or drilling or jackhammering. Second, it keeps the timepiece off the wrist and thus avoids impact as when the wrist brushes or hits a solid object or vice versa. Third, it places the timepiece out of the typical work line of fire, e.g., spray paint mist, welding sparks, nail pops, etc. Fourth, it provides for a single element to perform a duel function-namely, the strap of the cap both keeps the cap on the head and supports the timepiece so that there is no need for a separate timepiece strap or other attachment.

Figure 5:
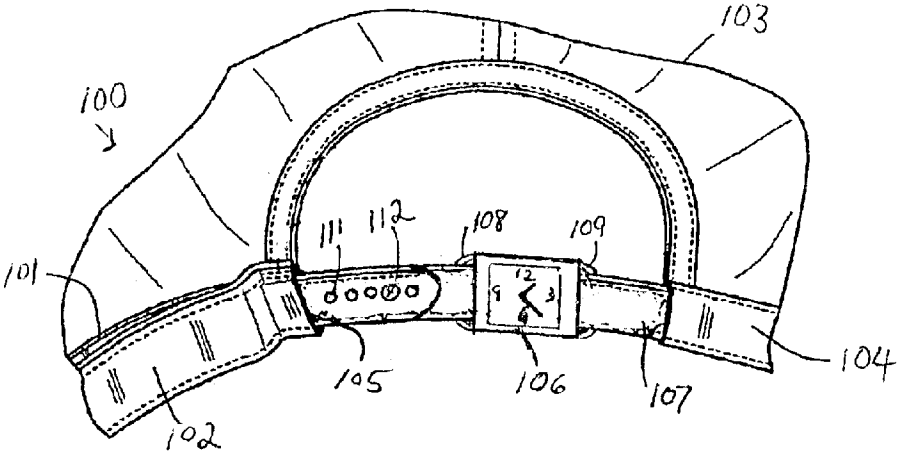
FIG. 5 shows one embodiment of a present invention cap with timepiece.

FIG. 5 shows one embodiment of a present invention cap with timepiece device 100, as generally outlined above. The device 100 includes a cap 101 with a skull-covering portion 103. It may include or exclude a visor, but will usually include a visor. In this embodiment, there is a single strap having a first end 105 and a second end 107, that passes all the way around and through a strap slot shown on the left as slot 102, and on the right as slot 104. Alternatively, these slots could be receivers for separate strap segments which would be permanently sewn into place.

As shown in FIG. 5, there is a timepiece 106 attached to strap end 107 with one of the attachment mechanisms discussed above, e.g., attachment mechanisms 108 and 109 having pins located behind end 107. In this case, strap ends 105 and 107 are removably and adjustably connected to one another with a plurality of orifices, such as orifice 111, on one end, and a fitting protrusion 112 on the other end. With this present invention arrangement, all of the advantages set forth above are now achieved.

Figure 6:
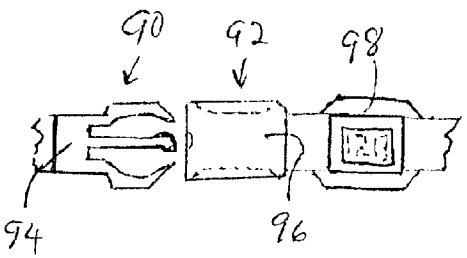
FIG. 6 shows a partial view of an alternative embodiment strap with timepiece as a cap component.

FIG. 6 shows a partial view of an alternative embodiment strap with timepiece as a cap component. Here, strap end 90 has a strap buckle 94 which is a squeeze-type buckle, for snap-lock/squeeze-release insertion into receiver 96 of second strap end 92. This would be an integral part of a present invention cap, wherein timepiece 98 is located on one of the strap segments.

Figure 7:
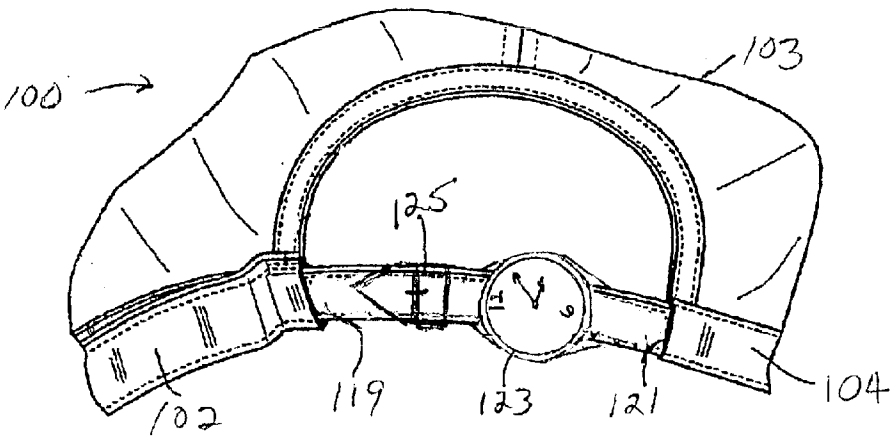
FIGS. 7, 8, 9, and 10 show rear perspective and rear views of various other embodiments of present invention caps with timepieces.

FIGS. 7, 8, 9, and 10 show rear perspective and rear views of various other embodiments of present invention caps with timepieces. FIG. 7 illustrates the same cap 100 that was shown in FIG. 5, except that a different strap attachment mechanism is shown. Thus, identical parts are identically numbered. Here strap ends 119 and 12 are connected by a conventional buckle 125, and timepiece 123 is attached thereto, as shown. Timepiece 123 has a straight twelve o'clock orientation, and these are included within the scope of the present invention caps, although the more preferred have the unique twelve o'clock orientation described above.

Figure 8:
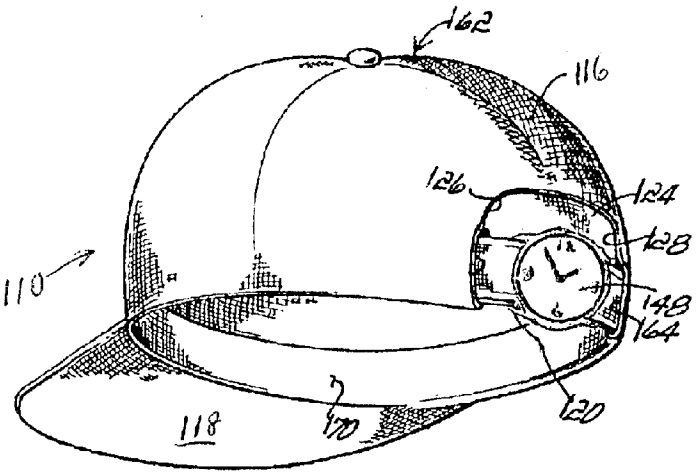

FIG. 8 shows another present invention device 110. It includes a skull-covering portion 162 and visor 118. There is a cutout 124 in the rear portion, with cutout sides 126 and 128, as shown. Expandable strap 164 has a watch 148 attached thereto. The watch 148 has strap attachment mechanisms, such as mechanism 120 to secure it to the strap. In this case, the watch 148 could be slid onto the strap 164 during production, so that it is permanently attached, or the attachment mechanisms could render it removable, e.g., by providing a D ring with a cutout on the ring to create a removable yoke attachment.

Figure 9:
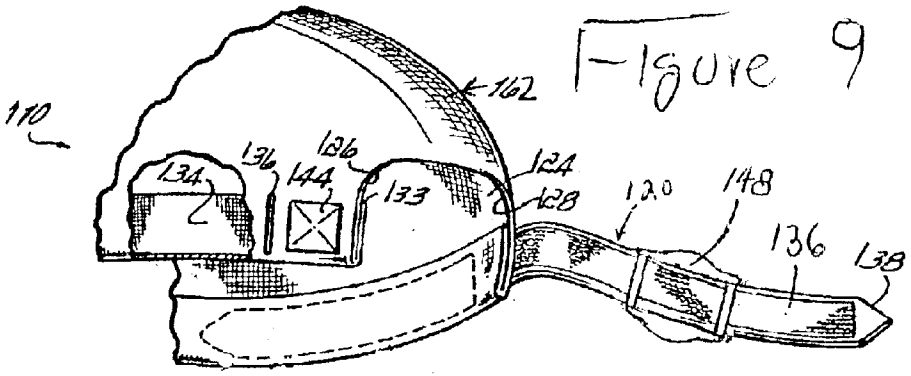

FIG. 9 illustrates a cap device 110 as shown in the foregoing Figure, with the same parts identically numbered, except that the strap 120 is a hook and loop type strap (commonly known as Velcro) and the timepiece 148 is easily removable. Here, to adjust and affix strap 120, strap end 138 is inserted into slot 133 and into sleeve 134. When positioned tightly on a head, strap 120 is pressed so that the loop and hok part 136 of the strap 120 connects with the loop and hook pad 144 for secured attachment. Adjustment or opening is achieved by reversing the aforesaid process.

Figure 10:
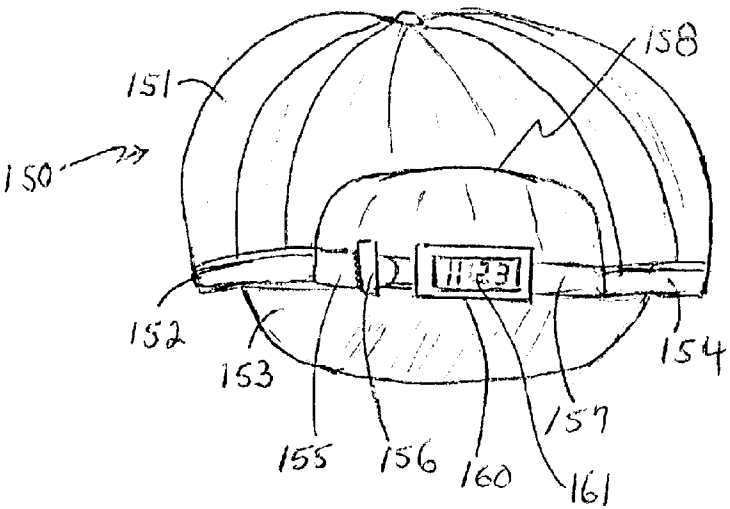

FIG. 10 shows another embodiment of a present invention device 150. It has a skull-covering portion 151, a visor 153, and a rear opening 158. There is a first strap segment 157, having a timepiece 160 with digital readout 161, and a second strap segment 155. The two segments 155 and 157 are removably connected by a teehted pinch buckle 156, as shown.

Figure 11:
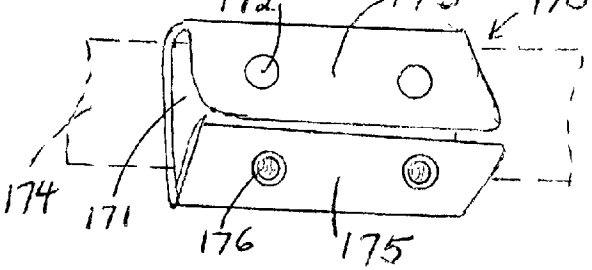
FIGS. 11 and 12 show alternative timepiece attachments for attaching timepieces to caps to create present invention embodiments; and, FIG. 13 illustrates a cap of the present invention that is a visor type cap.
Figure 12:
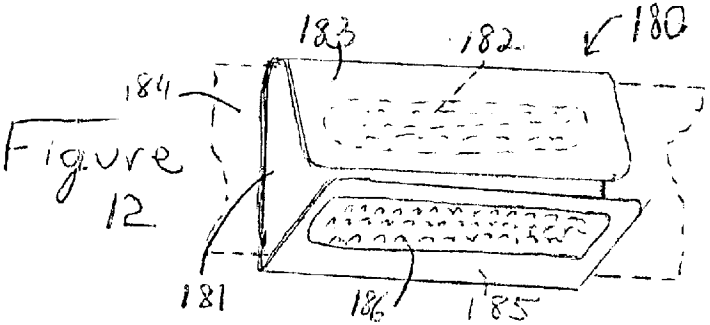

FIGS. 11 and 12 show alternative timepiece attachments for attaching timepieces to caps to create more alternative embodiments of the present invention. FIG. 11 shows a cap strap 174 in its partial backside view. There is a watch on the backside of attachment 170, which may be permanently or removably attached thereto, and this attachment 170 folds over the strap 174 to snap together. The front 171 is located on the front side of the strap 174, and the flaps 173 and 175 are folded over the strap and snapped together via the snaps, such as snap female portion 176 and snap male portion 172.

FIG. 12 shows a cap strap 184 in its partial backside view. There is a watch on the backside of attachment 180, which may be permanently or removably attached thereto, and this attachment 180 folds over the strap 184 to snap together. The front 181 is located on the front side of the strap 184, and the flaps 183 and 185 are folded over the strap and affix together via hook and loop attachments 182 and 186.

Figure 13:
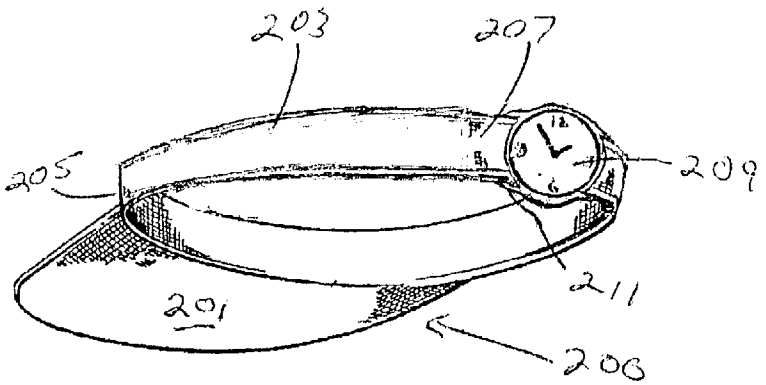

FIG. 13 illustrates a cap of the present invention that is a visor type cap 200. It includes a front visor 201 and a strap 203. The front 205 of strap 203 is connected to the front visor 201, as shown. The rear portion 207 of strap 203 includes timepiece 209 attached thereto via strap attachment mechanism 211, selected from any of the strap attachment mechanisms described above.

Obviously, numerous modifications and variations of the present invention are possible in light of the above teachings. For example, the timepiece itself may be molded or otherwise made with its own strap attachment mechanisms. Thus, a timepiece may have one male buckle end on one side and one female buckle end on an opposite side for fittage between two buckle parts of an existing cap strap. It is therefore understood that within the scope of the appended claims, the invention may be practiced otherwise than as specifically described herein.

What is claimed is:

1. A cap with timepiece, which comprises:

(a) a cap having a skull-covering portion adapted to fit atop a human head, said skull-covering portion having a base perimeter and having a rear cutout at back portion thereof;

(b) a cap strap extending across said rear cutout;

(c) a timepiece connected to said cap strap; wherein said cap strap simultaneously is functionable as a holding strap for said cap to enhance fittage to a human head, and as a timepiece strap.

2. The cap with timepiece of claim 1, wherein said cap strap is an adjustable strap.

3. The cap with timepiece of claim 2, wherein said cap strap is an elastically expandable strap.

4. The cap with timepiece of claim 2, wherein said cap strap is a two piece strap and has adjustment means for varied length connection of each of the two pieces of said strap.

5. The cap with timepiece of claim 4 wherein said adjustment means is a plurality of orifices located on a first strap piece and at least one orifice-insertable protrusion on a second strap piece.

6. The cap with timepiece of claim 4 wherein said adjustment means is a buckle on a first strap piece and a plurality of buckle holes on a second strap piece.

7. The cap with timepiece of claim 4 wherein said adjustment means is a clamp receiver buckle located on one of said two strap pieces.

8. The cap with timepiece of claim 1 wherein said timepiece includes two strap attachment mechanisms connected to a main housing, said two strap attachment mechanisms being at opposite ends of said main housing.

9. The cap with timepiece of claim 8 wherein said strap attachment mechanisms are pairs of protrusions with strap pins.

10. The cap with timepiece of claim 8 wherein said strap attachment mechanisms are selected from the group consisting of slotted receivers, flexible loops, inflexible loops and clamping strap attachments.

11. The cap with timepiece of claim 1 wherein said timepiece includes:

(a) a main housing having a front and a back, and containing a functional timekeeping means for timely driving at least an hour hand and a minute hand, said front adapted for presenting a timepiece face and faceplate said back being substantially flat, said front having an imaginary centerline extending outwardly from said main housing;

(b) two strap attachment mechanisms connected to said main housing, one of said two strap attachment mechanisms being centered about said imaginary centerline at a first end of said imaginary centerline, and the other of said two strap attachment mechanisms being centered about said imaginary centerline, opposite the other, at a second of said imaginary centerline;

(c) a faceplate located in said main housing face, and having at least a twelve symbol located thereon, wherein said twelve symbol is located about 90 degrees from said centerline;

(d) a driving shaft connected to and extending from said timekeeping means through said faceplate;

(e) an hour hand and a minute hand functionally connected to said driving shaft.

12. The cap with timepiece of claim 11 wherein said strap attachment mechanisms are symmetrical and directly opposite one another along said centerline.

13. The cap with timepiece of claim 11 wherein said strap attachment mechanisms are pairs of protrusions with strap pins.

14. The cap with timepiece of claim 11 wherein said strap attachment mechanisms are selected from the group consisting of slotted receivers, flexible loops, inflexible loops and clamping strap attachments.

15. The cap with timepiece of claim 11 wherein said timepiece is attached to a strap.

16. A cap with timepiece, which comprises:

(a) a cap having a skull-covering portion adapted to fit atop a human head, said skull-covering portion having a base perimeter and having a rear cutout at back portion thereof;

(b) a cap strap extending across said rear cutout;

(c) a timepiece connected to said cap strap said time piece having at least a twelve symbol located thereon wherein said twelve symbol is located about 90 degrees from said cap strap extending across said rear cutout;

wherein said cap strap simultaneously is functionable as a holding strap for said cap to enhance fittage to a human head, and as a timepiece strap.

17. The cap with timepiece of claim 16 wherein said cap strap is a two piece strap and has adjustment means for varied length connection of each of the two pieces of said strap.

18. The cap with timepiece of claim 17 wherein said adjustment means is a plurality of orifices located on a first strap piece and at least one orifice-insertable protrusion on a second strap piece.

19. The cap with timepiece of claim 17 wherein said adjustment means is a buckle on a first strap piece and a plurality of buckle holes on a second strap piece.

20. The cap with timepiece of claim 16 wherein said cap strap is an elastically expandable strap.

* * * * *